US005339286A

United States Patent [19]

Esposto

[11] Patent Number: 5,339,286

[45] Date of Patent: Aug. 16, 1994

[54] COMPOSITE ELECTROACOUSTIC TRANSDUCER

[75] Inventor: Lino Esposto, Senigallia, Italy

[73] Assignee: C.I.A.R.E. S.p.A., Senigallia, Italy

[21] Appl. No.: 3,051

[22] Filed: Jan. 11, 1993

[30] Foreign Application Priority Data

Jan. 14, 1992 [IT] Italy ..... B092A000012

[51] Int. Cl.[5] ..... H04R 23/00

[52] U.S. Cl. ..... 367/140; 367/175; 181/144; 181/157; 181/165; 381/182; 381/186; 381/202

[58] Field of Search ..... 367/140, 175; 181/144, 181/145, 148, 157, 165; 381/150, 182, 186, 202

[56] References Cited

U.S. PATENT DOCUMENTS

| | | | |
|---|---|---|---|
| 2,122,587 | 7/1938 | Ringel | 181/144 |
| 2,496,589 | 2/1950 | Marquis | 181/144 |
| 4,492,826 | 1/1985 | Chiu | 181/156 |
| 5,022,425 | 6/1991 | Prescott et al. | 137/82 |

*Primary Examiner*—J. Woodrow Eldred

*Attorney, Agent, or Firm*—Guido Modiano; Albert Josif; Daniel O'Byrne

[57] ABSTRACT

The composite electroacoustic transducer for reproducing medium and high frequencies comprises a transducer assigned to reproducing midrange frequencies provided with a dome-shaped membrane which extends in an annular shape. A transducer assigned to reproducing high frequencies is provided with a dome-shaped membrane and is arranged coaxially to the center of the transducer assigned to reproducing midrange frequencies.

4 Claims, 3 Drawing Sheets

COMPOSITE ELECTROACOUSTIC TRANSDUCER

BACKGROUND OF THE INVENTION

The present invention relates to a composite electroacoustic transducer for reproducing medium and high frequencies.

In the field of sound systems for high fidelity, the importance of the distance between the emission centers of the transducers used to reproduce the various frequencies is known. This distance can in fact cause significant alterations in the frequency response of the entire sound system. This is substantially due to the fact that in the so-called crossover regions, i.e. where the frequency ranges intersect one another, the transducers assigned to reproducing adjacent frequency ranges, for example medium and high ones (otherwise known as midranges and tweeters) simultaneously emit the same frequency with the same intensity.

For the sake of greater clarity, FIG. 2 illustrates the case in which the listening point Po is in any point of the plane M which is median with respect to the segment which joins the two emission centers P1 and P2. In this case, the distances of the listening point Po from said emission centers P1 and P2 are identical, so that the sound waves produced by the transducers arrive at said point Po at the same time and mutually in phase. This produces a 6 dB increase in sound pressure level with respect to the level produced by a single transducer.

If vice versa, as shown in FIG. 3, the listening point Po is on a plane N which is different from said median plane M, the respective distances from the emission centers P1 and P2 are different, so that the sound waves produced by the transducers arrive at said point Po at different times and with different phases. The maximum phase opposition (180°) occurs for all positions of the listening point Po in which the difference between said distances is equal to half the wavelength of the emitted frequency. In this case, the two emissions cancel each other out, producing a deep attenuation in frequency response.

Finally, in this case, if the frequency of the applied signal is changed in a continuous manner, one observes a first significant attenuation in frequency response at the frequency whose half-wavelength is equal to the difference between the distances of the emission centers from the point Po, followed by a series of successive attenuations which repeat at odd multiples of the emitted frequency, as shown in the frequency response chart shown in FIG. 4.

Ultimately, the combination of the effects produced by the distance of the listening point from the emission centers of the transducers and by the range of frequencies reproduced by both of said transducers causes a change in the frequency response of the sound system as a whole and a difficult reconstruction of the sound image to obtain a correct stereophonic effect.

In order to reduce this problem, the emission centers of the midrange and of the tweeter are usually placed as close as possible to each other. However, this solution has a physical limit constituted by the bulk of the magnetic assemblies of the electroacoustic transducers used.

Therefore, conventional transducers of the above described type often have a non-optimum sound quality and have relatively large dimensions and a proportionately high weight. This constitutes an evident limitation, especially in the fields of application in which reduced bulk and weight are required, for example for high-fidelity systems to be installed in motor vehicles and the like.

SUMMARY OF THE INVENTION

The aim of the present invention is to solve the above problem by providing a composite electroacoustic transducer which allows to reproduce medium and high frequencies with high sound quality and with a modest bulk and weight.

Within the scope of this aim, an object of the present invention is to provide an electroacoustic transducer which is simple in concept, reliable in operation and versatile in use.

This aim and this object are both achieved, according to the invention, by the present composite electroacoustic transducer for reproducing medium and high frequencies, which is characterized in that it comprises a transducer assigned to reproducing medium frequencies which is provided with a dome-shaped membrane which extends in an annular shape and a transducer assigned to reproducing the high o frequencies which is provided with a dome-shaped membrane which is arranged coaxially to the center of said transducer assigned to reproducing medium frequencies.

BRIEF DESCRIPTION OF THE DRAWINGS

The details of the invention will become apparent from the detailed description of a preferred embodiment of the electroacoustic transducer for reproducing medium and high frequencies, illustrated only by way of non-limitative example in the accompanying drawings, wherein.

DESCRIPTION OF THE PREFERRED EMBODIMENTS

Figure 1:
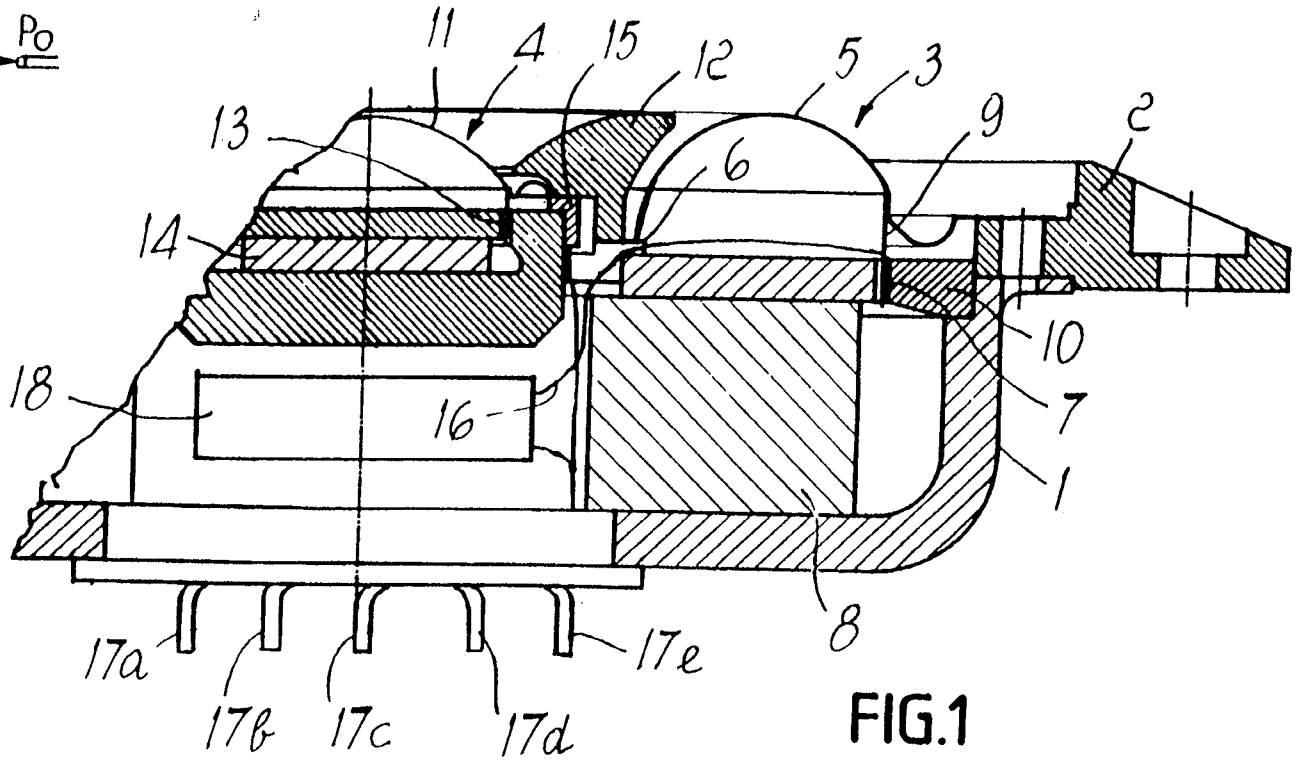
FIG. 1 is a partial sectional axial view of the composite electroacoustic transducer according to the invention.
Figure 2:
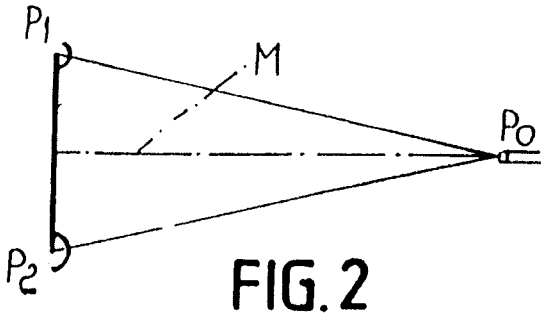
FIGS. 2 and 3 illustrate the different positions of the listening point with respect to emission centers arranged side by side.
Figure 3:
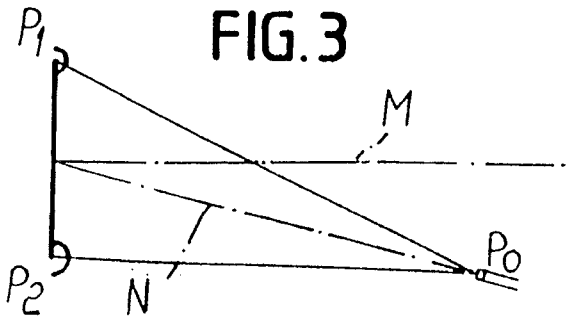
Figure 4:
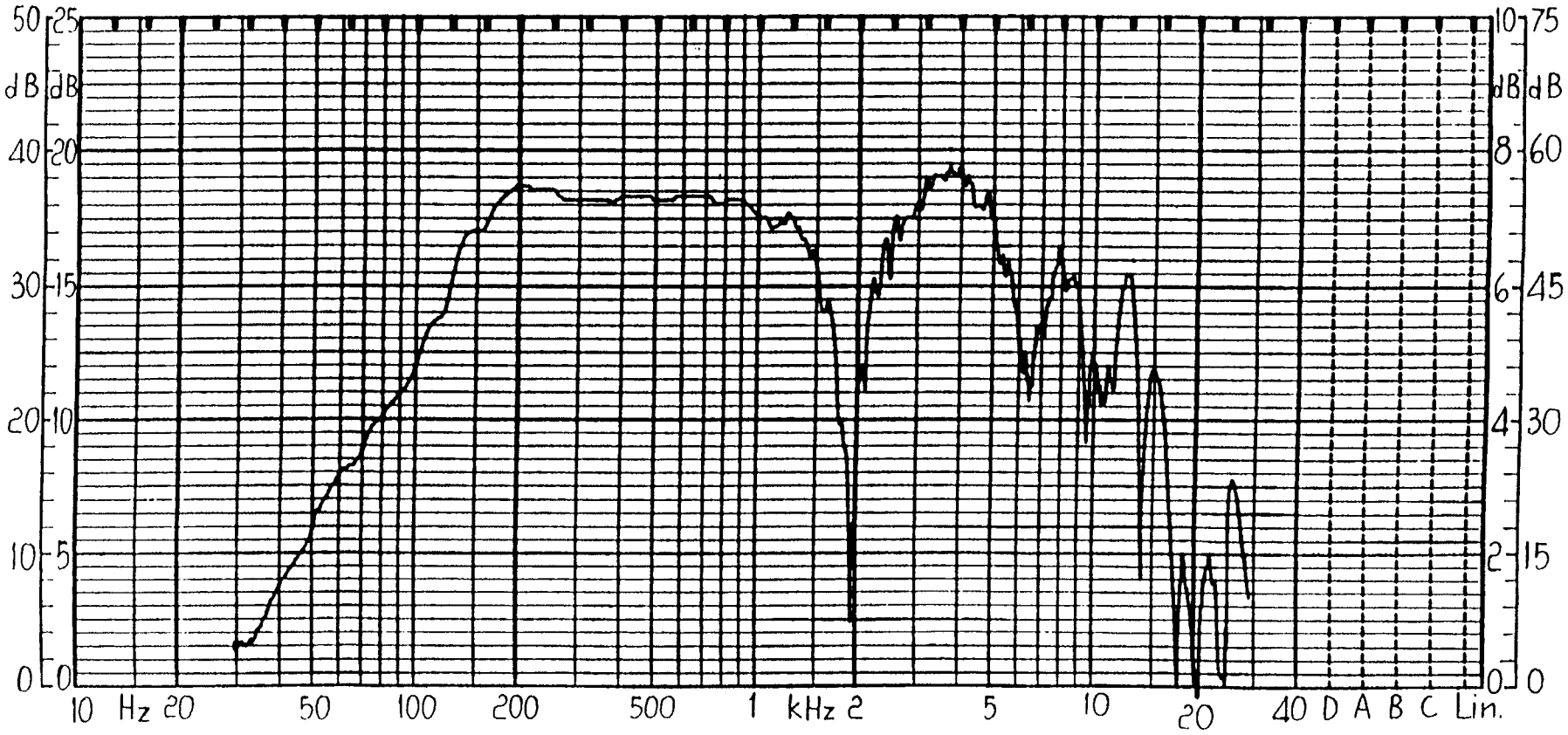
FIG. 4 is a chart of the frequency response of two transducers arranged side by side, fed with the same signal; the response is detected by the microphone Po arranged as in FIG. 3.

With particular reference to FIG. 1, the reference numeral 1 designates the supporting basket of the composite electroacoustic transducer for reproducing medium and high frequencies. The basket 1, also known as magnetic vessel, is surrounded by a flange 2 whose external profile is shaped like a quadrilateral whose curved sides are connected by arcs of circumferences. Said profile of the flange 2 preferably extends along cross-sections whose extent decreases along the vertical axis, until the circular cross-section is reached at an internal annular region, as shown in detail in the Italian multiple ornamental model application no. BO910 000042 filed in the name of Electronic Melody S.A.p.A. di Paola Giannini.

The composite electroacoustic transducer according to the invention comprises a transducer 3 assigned to reproducing the medium frequencies, known as midrange, and a transducer 4 assigned to reproducing high frequencies, known as tweeter, both of which are mounted coaxially inside the basket or housing 1.

The midrange transducer 3 is constituted by a dome-shaped membrane 5 which extends in an annular shape. By means of an appropriate adhesive, the annular membrane 5 is fixed to the peripheral flange 2 along its outer edge and to an internal ring 6 along its internal edge.

The annular membrane 5 is moved by a moving coil 7 immersed in the magnetic field generated by an annular magnet 8 which is arranged inside said coil 7; the magnet 8 is fixed by means of an appropriate adhesive to the bottom of the housing 1. The coil 7 is wound on a support 9 and is kept centered by the flange 2 by means of an appropriate step defined on the polar plate 10 of the housing 1.

The tweeter 4 is constituted by a dome-shaped membrane 11 arranged coaxially to the center of the annular membrane 5 of the midrange transducer 3; the membrane 11 is supported by a further annular flange 12 arranged internally with respect to the annular membrane 5. The membrane 11 is driven by a moving coil 13 which is immersed in the magnetic field generated by an iron-boron-neodymium magnet 14. The coil 13 is constituted by the winding of an aluminum wire on a polyimide support. The moving element of the tweeter 4 is supported by a ring 15 which is rigidly coupled to the flange 12.

Figure 5A:
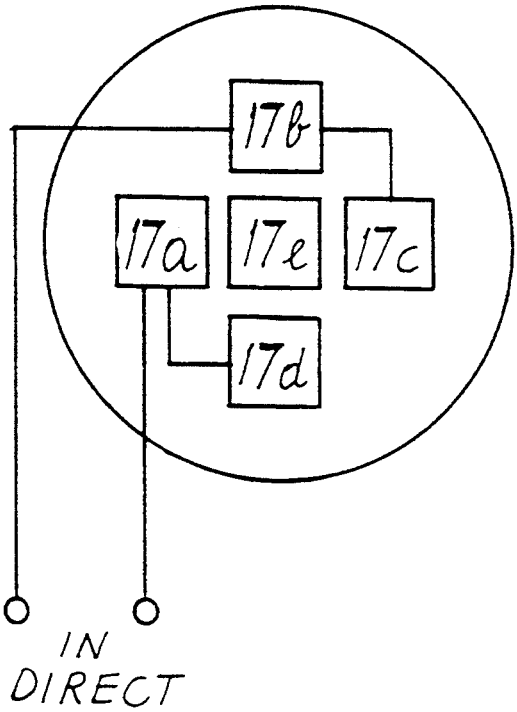
FIGS. 5*a* and 5*b* illustrate respective connection possibilities of the composite electroacoustic transducer.
Figure 5B:
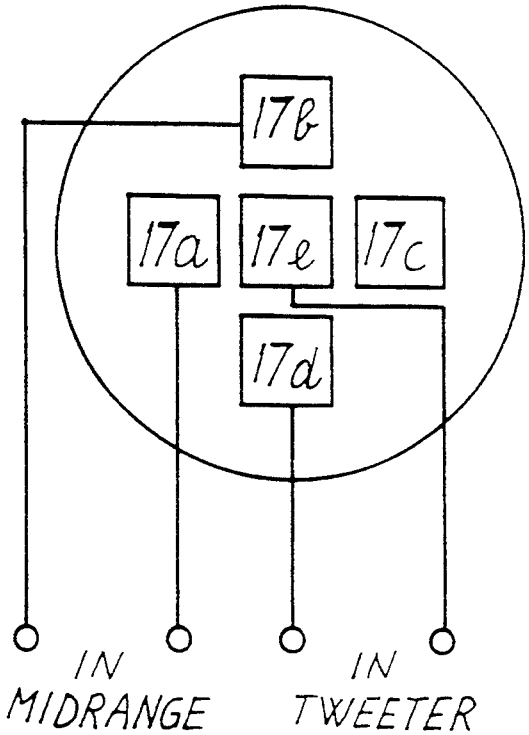

The coils 7 and 13 are connected by means of appropriate conductors 16 to a series of five terminals 17*a*, 17*b*, 17*c*, 17*d*, 17*e* which protrude from the bottom of the housing 1 and are appropriately mutually connected by jumpers. According to FIG. 5*a*, coupling to the terminal 17*a* and to the terminal 17*b* allows the direct use of the composite electroacoustic transducer, using an appropriate crossover filter 18 (FIG. 1) arranged inside the basket 1. According to FIG. 5*b*, by eliminating the jumpers of FIG. 5*a*, it is instead possible to individually connect the midrange to the terminals 17*a* and 17*b* and the tweeter to the terminals 17*d* and 17*e*, thus bypassing the crossover filter. It should be noted that the conductors 16 pass within the magnetic assembly of the composite transducer.

The described composite electroacoustic transducer allows reproduction of medium and high frequencies with high sound quality while maintaining a modest bulk and weight. This result is provided particularly by the coaxial arrangement of the dome-shaped membranes of the midrange transducer and the tweeter. The use of an iron-boron-neodymium magnet to drive the tweeter coil also contributes to reduce the weight and bulk of the composite electroacoustic transducer.

In the practical execution of the invention, the materials employed, as well as the shades and dimensions, may be any according to the requirements.

I claim:

1. Composite electroacoustic transducer for reproducing medium and high frequencies, comprising a transducer assigned to reproducing medium frequencies provided with a convex-shaped membrane which extends in an annular shape and a transducer assigned to reproducing high frequencies provided with a convex-shaped membrane arranged coaxially to the center and on the same plane of said transducer assigned to reproducing medium frequencies.

2. Composite electroacoustic transducer according to claim 1, wherein said convex-shaped membrane of the transducer assigned to reproducing high frequencies is driven by a moving coil which is immersed in the magnetic field generated by an iron-boron-neodymium magnet.

3. Composite electroacoustic transducer according to claim 2, wherein said moving coil is constituted by a winding of an aluminum wire on a polyimide support.

4. Composite electroacoustic transducer according to claim 1, wherein said convex-shaped membranes are driven by respective moving coils connected, by means of related conductors which pas through a magnetic vessel containing said moving coils and the magnets generating the magnetic field for said moving coils, to a series of terminals which allow for the selection between the use or the bypassing of a suitable frequency crossover filter inserted in said magnetic vessel.

* * * * *